United States Patent [19]

Chandler

[11] Patent Number: 4,901,457

[45] Date of Patent: Feb. 20, 1990

[54] CONTAINER LABEL

[76] Inventor: Donald O. Chandler, 9724 W. Hayes Pl., West Allis, Wis. 53227

[21] Appl. No.: 107,272

[22] Filed: Oct. 13, 1987

[51] Int. Cl.[4] ..... G09F 3/00

[52] U.S. Cl. ..... 40/306; 40/310; 40/312

[58] Field of Search ..... 40/306, 310, 312, 107; 116/306, 308, 316–319; 283/70, 71, 73, 74, 81

[56] References Cited

U.S. PATENT DOCUMENTS

| | | | |
|---|---|---|---|
| 1,588,964 | 6/1926 | Hutchins | 283/81 |
| 2,324,885 | 7/1943 | Sherrill | 283/21 |
| 2,709,001 | 5/1955 | Stahl | 283/36 |
| 3,484,976 | 12/1969 | Shea | 40/310 |

FOREIGN PATENT DOCUMENTS

| | | | |
|---|---|---|---|
| 364256 | 8/1906 | France | 40/310 |
| 847683 | 10/1939 | France | 40/310 |
| 176046 | 3/1935 | Switzerland | 40/312 |

*Primary Examiner*—Kenneth J. Dorner
*Assistant Examiner*—J. Hakomaki
*Attorney, Agent, or Firm*—Quarles & Brady

[57] ABSTRACT

A container label of tearable sheet material, such as paper, is formed with an array of open slots. The slots are formed adjacent a discontinuity in the sheet. The discontinuity may be a marginal edge of the label, or slits associated with each slot, or both. The label is physically alterable by a user tearing away a portion of the sheet from a slot toward its discontinuity to thereby alter the appearance of the label and personalize the label.

9 Claims, 2 Drawing Sheets

FIG. 1
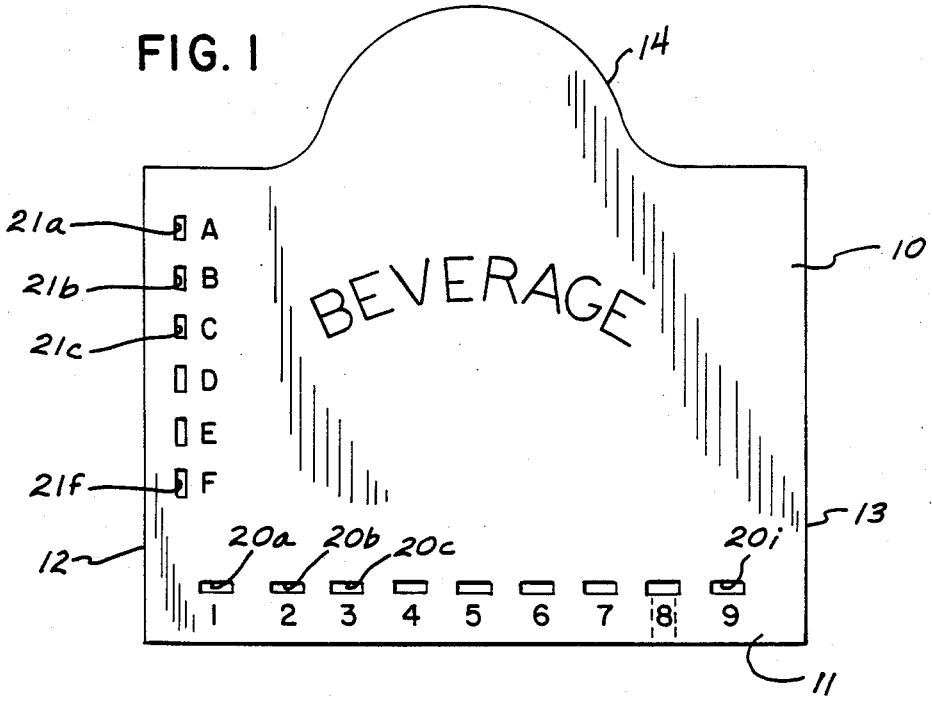
FIG. 4
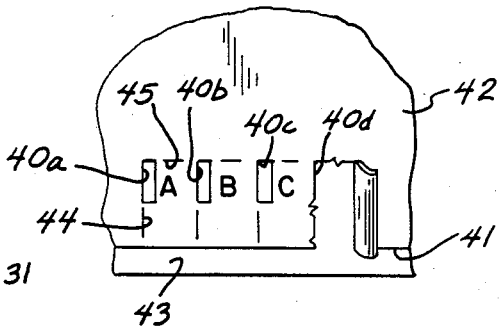
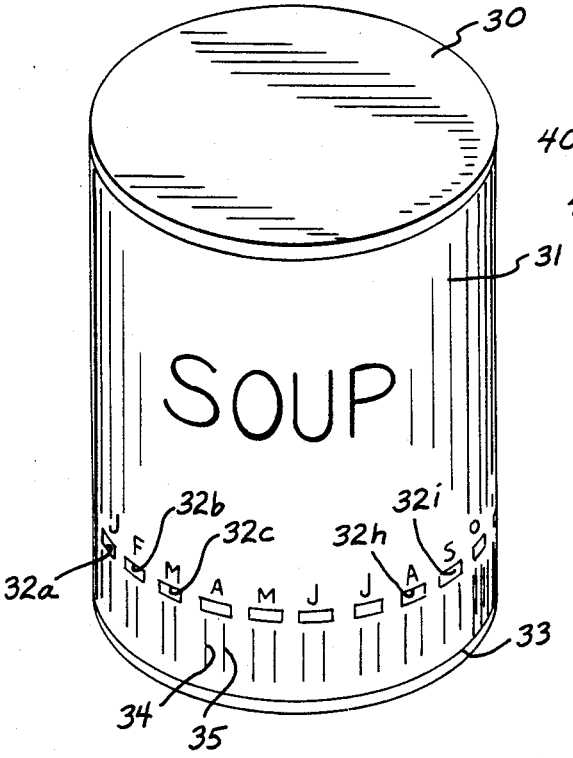
FIG. 2
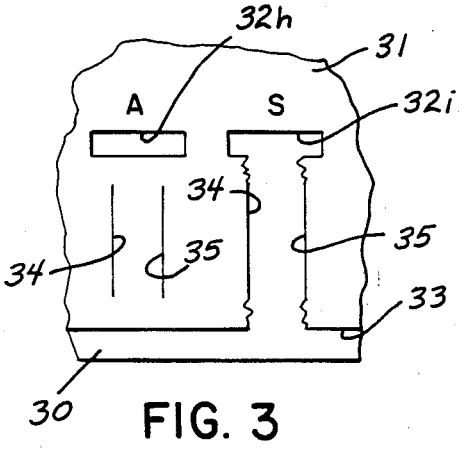
FIG. 3

CONTAINER LABEL

BACKGROUND OF THE INVENTION

This invention relates to a container label, and particularly to a label which can be altered by the purchaser or user of the container to provide a unique visual indication for the container.

Labels for bottles and cans are generally formed of a paper which is glued to the surface of the container. The purchasers of the labeled containers often have a need for making a visible mark on the label to uniquely identify the container. For example, purchasers of identical bottles may wish to individually mark their bottle to distinguish it from the others so that there is no accidental consumption of the contents of a bottle by someone other than the purchaser. Similarly, purchasers of canned products may wish to mark the can to indicate the date on which it was purchased and to thereby guide the purchaser in determining when the contents of the can ought to be consumed.

These personalized markings on container labels have heretofore been accomplished by writing on the label or by physically altering the label in some way. A container label in accordance with the present invention provides a simple and effective way in which to personalize the container label.

SUMMARY OF THE INVENTION

A container label in accordance with the invention is formed of a tearable sheet with a plurality of spaced slots formed in the sheet adjacent to a discontinuity in the sheet. The portion of the sheet defined by each slot and its adjacent discontinuity is physically displaceable by tearing away from the slot toward the discontinuity. The portion of the sheet may be completely removed by the tearing action or the portion may remain attached to the label. In either case, the label will have been altered in a personalized fashion.

Each slot will typically have printed indicia associated with it for identifying the slot. The printed indicia may be a simple series of numbers or letters, or may represent a code for time dating the label or for other purposes. The printed indicia may be placed on the portion of the sheet that is torn away or may be placed on an area of the label that remains.

In one preferred embodiment, the discontinuity includes a marginal edge of the sheet and the slots are spaced inwardly from the marginal edge. The portion of the sheet between each slot and the marginal edge is displaceable by tearing away from the slot to the marginal edge. The portions of the sheet material between each slot and the marginal edge may be weakened to facilitate the removal of the sheet portion by tearing. The weakening may be accomplished by slits that extend over part of the space between the slot and the marginal edge and which direct the tearing action.

The tearing away of the material from the slot to the marginal edge is readily accomplished by a fingernail of the user or by some other similar instrument.

In another preferred embodiment, the discontinuity includes a pair of spaced slits extending from adjacent each slot into the body of the sheet. The tearing away from the slot to and between the slits results in a portion of the sheet that remains attached but is physically displaced from the remainder of the label.

The slots and slits may be die cut into the sheet material for the label prior to the label being glued to the container.

It is a principal object of the invention to provide a container label which may be readily altered by the user or purchaser of the container to give a unique visual indication.

The foregoing and other objects and advantages of the invention will appear in the detailed description which follows. In the description, reference is made to the accompanying drawings which illustrate preferred embodiments of the invention.

BRIEF DESCRIPTION OF THE DRAWINGS

FIG. 1 is a plan view of a bottle label in accordance with the invention;

FIG. 2 is a view in perspective of a can with a label according to the invention attached to the can; and FIG. 3 is an enlarged view of a portion of the label of FIG. 2 showing the slots and slits;

FIG. 4 is a fragmentary view of a further embodiment of the label shown mounted on a container;

DETAILED DESCRIPTION OF THE PREFERRED EMBODIMENTS

Figure 5:
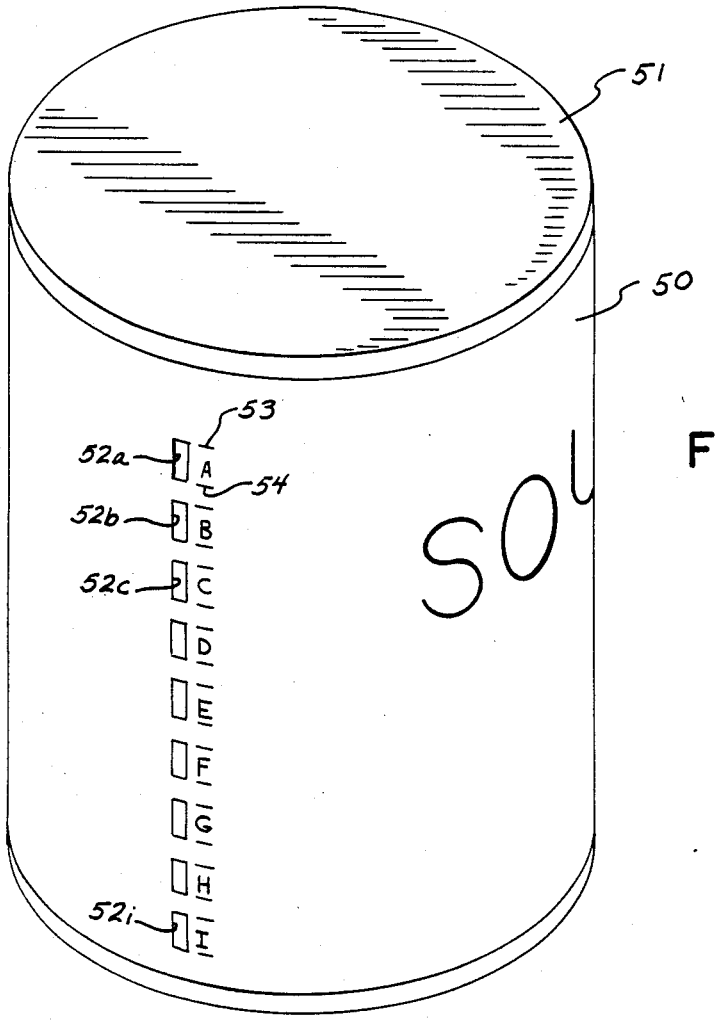
FIG. 5 is a view in perspective of a can with yet another embodiment of the label attached to the can.

Referring to FIG. 1, a label 10 is formed of paper or other tearable substance. The label 10 is specifically designed to be glued to a beverage bottle, such as a beer or soft drink bottle. The label 10 has a bottom marginal edge 11 and side marginal edges 12 and 13 as well as a top edge 14 which is of an irregular shape. A series of open slots 20*a*, 20*b*, 20*c*, etc., are formed in the label 10 extending parallel to the bottom marginal edge 11 and spaced inwardly from that marginal edge a short distance. A second series of open slots 21*a*, 21*b*, 21*c*, etc. are formed in a line parallel to the side marginal edge 12 and spaced inwardly therefrom a short distance. Printed indicia are associated with each of the series of slots 20 and 21. Thus, the series of slots 20 are marked by a series of printed numbers while the slots 21 are marked by a series of letters. As a result, each slot 20 or 21 has a unique printed indicia associated with it.

The slots 20 and 21 are die cut into the sheet of the label 10 before the label is attached to a bottle. When the label 10 is attached to and wrapped around the bottle, each of the slots 20 and 21 provides an opening for a fingernail, or other similar instrument, to engage an edge of a slot and to tear away the portion of the label between a slot and its respective marginal edge. An example is the slot labeled 8 in FIG. 1 where the torn away portion is identified by dotted lines. The purchaser or consumer of the bottle to which the label 10 is affixed can thereby readily select one of the slots to be torn away to personalize that bottle from other identical bottles to avoid confusion with the identical bottles.

As shown in FIG. 1, the printed indicia may be located on the label 10 between the slots 20 and the marginal edge 11, in which case the printed indicia associated with a slot will be removed when the slot is torn away. Alternately, the printed indicia may be on the main body of the label 10 where it will remain after tearing away from a slot, as exemplified by the printed letters associated with the slots 21.

FIGS. 2 and 3 illustrate a container label in accordance with the invention applied to a metal can 30. The label 31 is wrapped around the can in the usual manner. A series of slots 32*a*, 32*b*, 32*c*, etc. is formed in a line parallel to a bottom marginal edge 33 of the label 31 and spaced inwardly therefrom a short distance. Each of the slots 32 has associated with it a unique printed indicia. In the embodiment illustrated in FIG. 2, the printed indicia are the first letters of the twelve months of the year. Upon being purchased, the can label can be physically altered by the purchaser by tearing away with a fingernail or similar object a slot at the month of the year in which the can is purchased.

In the embodiment of FIGS. 2 and 3, the tearing away of the label material between a slot and its associated marginal edge is facilitated by providing a series of parallel slits 34 and 35 associated with each slot 32 and which extend along a portion of the space between a slot 32 and the marginal edge 33. Note that the slits 34 and 35 do not extend to either a slot 32 or a marginal edge 33. The slits 34 and 35 can be die cut into the label along with the slots 32 prior to the label being attached to the container. The distance between the slits 34 and 35 may be equal to the length of an adjoining slot 32, if desired.

FIG. 3 shows the A (August) and S (September) slots of the label 31 with the portion of the label adjacent the September slot having been torn away towards the marginal edge to identify that the can was purchased in the month of September.

In the embodiments of FIGS. 1–3, the slots are aligned with their long dimension parallel to the associated marginal edge. As a result, the entire portion of the sheet between the slot and the marginal edge is typically removed by tearing away. In the embodiment of FIG. 4, an alternative approach is illustrated in which the tearing from the slot does not result in the removal of the portion but instead in the folding over of a portion of the label. This is accomplished by aligning a major dimension of a series of slots 40*a*, 40*b*, 40*c*, etc., perpendicular to the marginal edge 41 of a label 42 mounted on a container 43. A slit 44 extends over a portion of the distance between each slot 40 and the marginal edge 41. A second slit 45 extends in a direction along the upper edge of each slot 45 over a portion of the distance between adjacent slots. As illustrated in FIG. 4, upon tearing away of a particular slot 40*d*, a portion 46 of the label 42 remains attached and is in effect hinged to and may be folded over the label.

The series of slots can be provided adjacent any marginal edge of a label which, when attached to its container, will not overlap another portion of the same or of a similar label.

Figure 6:
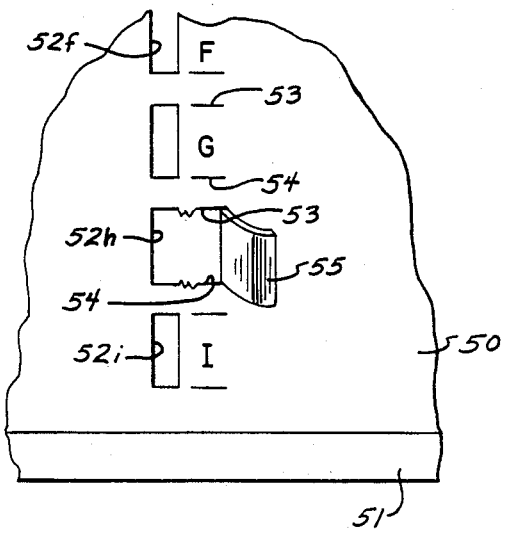
FIG. 6 is an enlarged view of a portion of the label of FIG. 5 showing the slots and slits.

In all of the above described embodiments, a marginal edge of the label is used, with or without associated slits, to provide a discontinuity in the label toward which the tearing action is directed. FIGS. 5 and 6 illustrate an embodiment of the label in which the slots are not associated with a marginal edge. Instead, the discontinuity in the sheet is provided solely by pairs of parallel slits. Specifically, a label 50 is attached to a can 51. The label 50 has a series of aligned and spaced open slots 52*a*, 52*b*, 52*c*, etc.. A pair of parallel slits 53 and 54 extend from a point adjacent an edge of a slot 52 into the body of the label 50. As shown in FIG. 6, a portion of the sheet adjacent each slot is displaceable by tearing away from the slot, such as the slot 52*h*, into the area between the slits 53 and 54. A portion 55 of the sheet material of the label remains attached but a visual indication is presented of the physical alteration that has been made to the label 50.

Although the label is preferably made of paper, as is typical with container labels, any material that is readily tearable by using a fingernail would be appropriate for use.

I claim:

1. In combination with a container, a container label comprising:

a tearable sheet having a rear surface disposed entirely against the outer surface of the container, said sheet having at least one continuous marginal edge with a plurality of spaced slots formed in the sheet and that are adjacent to and spaced inwardly from the marginal edge, the portion of the sheet between each slot and the marginal edge being adapted to be adhere to a container and being displaceable by tearing away from the slit to the marginal edge, the sheet portion between each slot and the marginal edge is weakened to facilitate the removal of the sheet portion by tearing.

2. A label in accordance with claim 1 together with indicia on the front surface of the sheet, said indicia being associated with the slots for identifying each slot.

3. A label in accordance with claim 2 wherein the indicium for each slot is unique to that slot.

4. A label in accordance with claim 2 wherein the indicia are located on the portions of the sheet between each slot and the marginal edge.

5. A label in accordance with claim 1 wherein the weakened portion adjacent each slot is defined by spaced slits that extend along a part of the space between the slot and the marginal edge.

6. In combination with a container, a container label comprising:

a tearable sheet having a rear surface disposed entirely against the outer surface of the container, said sheet having at least one continuous marginal edge with a plurality of spaced open slots formed in the sheet and that are spaced inwardly from the marginal edge a short distance, the portion of the sheet between each slot and the marginal edge being adapted to be adhered to a container and being removable by tearing away from the slot to the marginal edge, the sheet also having a pair of spaced slits extending along a portion of the distance between each slot and the marginal edge.

7. A container label, comprising:

a tearable sheet having at least one continuous marginal edge with a plurality of spaced open slots formed in the sheet that are spaced inwardly from the marginal edge a short distance, the sheet portion between the slots and the marginal edge being adapted to be adhered to a container, the sheet portion between each slot and the marginal edge and between adjacent slots being weakened to facilitate the tearing away of the sheet on a line between the slot and the marginal edge and the tearing away between adjacent slots whereby the sheet portion between each slot and the marginal edge will remain connected to the remainder of the label when the sheet portion has been torn along the weakened lines.

8. A container label in accordance with claim 9 wherein the weakened portions adjacent each slot are defined by a slit that extends along a portion of the line between the slot and the marginal edge and a second slit that extends along a portion of the line between adjacent slots.

9. A container label, comprising:

a tearable sheet adapted to be adhered to a container and having a plurality of spaced open slots formed in the sheet remote from a marginal edge of the sheet, and a pair of spaced slits extending into the sheet from adjacent each slot, the portion of sheet defined by a slot and its adjacent slits being displaceable by tearing away from the slot and along the slits whereby the sheet portion defined by a slot and adjacent pair of slits will remain connected to the label when the sheet portion has been torn along the slits.

* * * * *